United States Patent [19]

Cunningham

[11] 3,994,083

[45] Nov. 30, 1976

[54] TRENCHER CONSTRUCTION

[76] Inventor: James E. Cunningham, c/o Speicher Bros., Inc., Celina, Ohio 45822

[22] Filed: Sept. 25, 1974

[21] Appl. No.: 509,099

[52] U.S. Cl. ..... 37/80 R; 37/91; 37/94; 212/138; 212/142; 214/49; 280/638; 280/405 R

[51] Int. Cl.[2] ..... E02F 5/02; E02F 5/08; B62D 37/04

[58] Field of Search ..... 37/80 R, 81, 85, 83, 37/91, 94, 92, 103, 95–97, 93, 82; 280/34 R, 34 A, 405 R, 80 R, 405 A, 80 B; 214/138 C, 142; 212/49

[56] References Cited

UNITED STATES PATENTS

| | | | |
|---|---|---|---|
| 1,265,705 | 5/1918 | Litchfield | 280/80 B |
| 1,320,601 | 11/1919 | Caron | 280/405 R |
| 2,832,610 | 4/1958 | Le Tarte | 280/405 A |
| 2,841,895 | 7/1958 | Lindell et al. | 37/97 |
| 2,897,986 | 8/1959 | Davis | 214/138 C X |
| 2,995,844 | 8/1961 | Askue | 37/97 |
| 3,131,492 | 5/1964 | Speicher et al. | 37/94 |
| 3,140,745 | 7/1964 | Hinkle et al. | 37/1 X |
| 3,222,802 | 12/1965 | Kiernan | 37/43 R |
| 3,301,416 | 1/1967 | Bopp | 280/34 R |
| 3,394,554 | 7/1968 | Kinnan | 37/94 UX |
| 3,554,395 | 1/1971 | Dunbar | 212/49 X |
| 3,559,415 | 2/1971 | Vaughan et al. | 37/81 X |
| 3,616,953 | 2/1971 | Shaffer et al. | 280/34 R X |
| 3,653,131 | 4/1972 | Pilch | 37/1 |
| 3,685,853 | 8/1972 | Goldsmith | 280/34 A X |
| 3,727,331 | 4/1973 | Hansen | 37/193 X |
| 3,967,396 | 7/1976 | Maisonneuve et al. | 37/94 X |

FOREIGN PATENTS OR APPLICATIONS

| | | | |
|---|---|---|---|
| 1,531,318 | 7/1968 | France | 37/82 |
| 1,332,294 | 12/1963 | France | 37/80 R |
| 405,950 | 7/1966 | Switzerland | 280/80 B |

*Primary Examiner*—Edgar S. Burr
*Assistant Examiner*—Steven A. Bratlie
*Attorney, Agent, or Firm*—Robb & Robb

[57] ABSTRACT

There is disclosed a trenching machine construction of vehicular type, having a wheeled chassis for travel movement with frames connected thereto, whereby trenching means supported by said frames are adjustable vertically, transversely and angularly with respect thereto, the weight of the means being shiftable longitudinally for such travel movement, means and power for effecting such adjustments being provided.

1 Claim, 4 Drawing Figures

TRENCHER CONSTRUCTION

OBJECTS OF THE INVENTION

It is a principal object of this invention to provide a small trenching machine of vehicular type which may be used in closely confined quarters on hillsides and grades which inhibit the use of large machines, the machine hereof being self-contained and suitably driven for either over-the-road travel or movement in the restricted areas suggested.

Another object of the invention is to provide a small trenching machaine of the class described, which is suitably operated by hydraulic instrumentalities generally as a main concept thereof, with control being provided to effect movement of the frame on a chassis frame so that travel movement may be effected with shifting of the weight to balance the weight during such movement as may be desired.

A further object of the invention is to provide a trenching machine of the class described, which has unique adjustments so that transverse shifting of the trenching instrumentalities may be effected, vertical adjustment for maintaining vertical trenching on hillsides during travel movement is possible, and shifting of the entire trenching unit from side to side of the vehicle may be effected together with the longitudinal movement of the instrumentalities for shifting the weight so that a compact, flexible, universal machine is provided.

Other and further objects will be understood from a consideration of the specification appended hereto, and disclosed in the drawings wherein.

Figure 2:
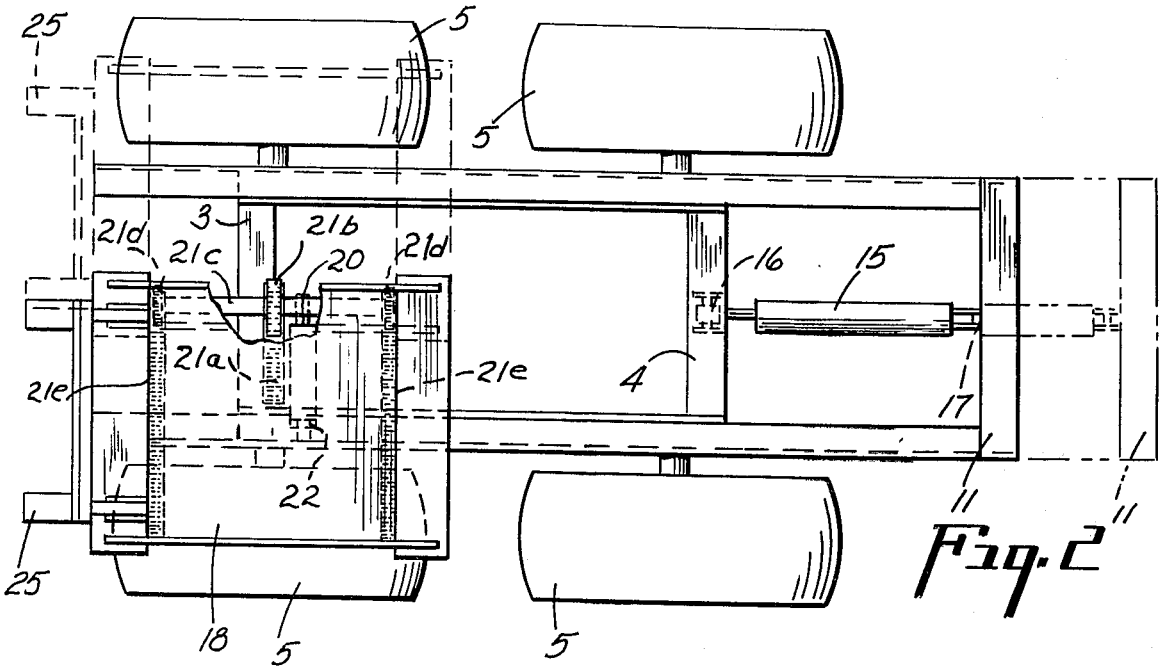
FIG. 2 is a plan view in top elevation, suggesting the general layout of the machine with a substantial number of details omitted so as to indicate in greater detail the potential adjustable movement of a secodndary frame.

FIG. 2 *a* is a view similar to FIG. 2, with the instrumentalities in centrally adjusted position.

Figure 3:
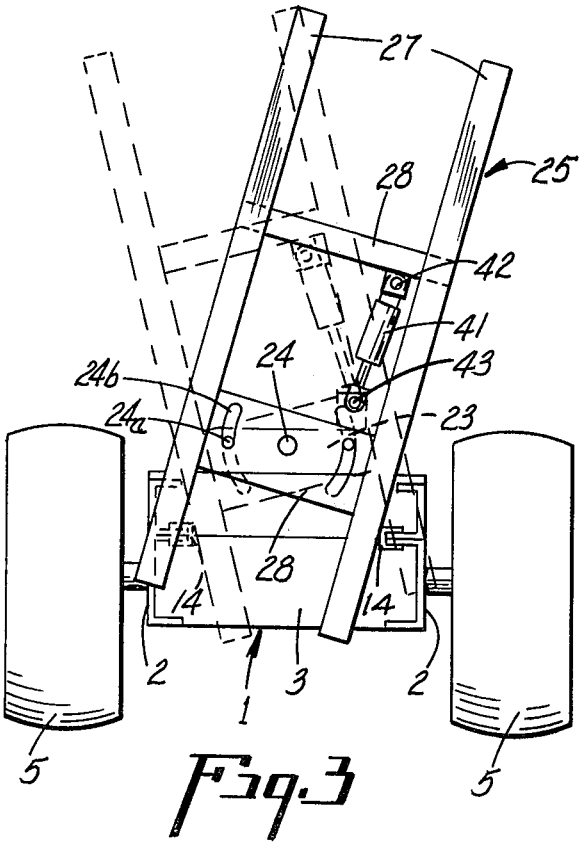

FIG. 3 is a rear view, partly fragmentary, omitting some of the commonly suppliable elements and illustrating the adjustability of the mast assembly hereof.

Figure 1:
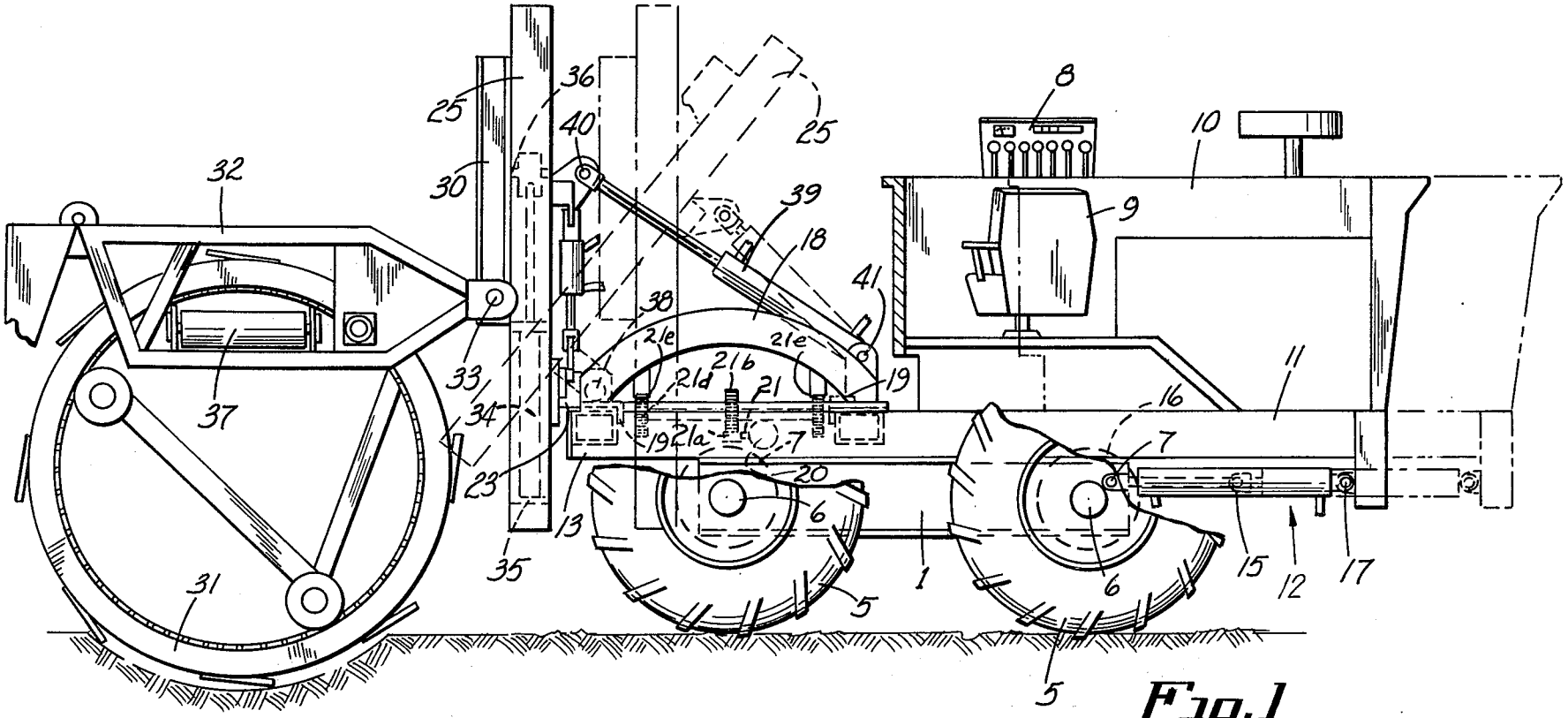
FIG. 1 is a side elevation view, partly fragmentary with the main instrumentalities illustrated, certain details being omitted as suitably provided by those skilled in the art.

DESCRIPTION OF THE INVENTION The invention hereof is shown in FIG. 1 as comprising a chassis unit, generally designated 1, which consists essentially of a generally rectilinear frame having the side frame members 2 spaced so and maintained in spaced condition by fore and aft members 3 and 4.

This frame may be constructed of suitable channel members as will be understood, and is shown as being supported by four wheels designated 5, in each case being a rubber tired wheel, and mounted on axles 6 with drive means for such axles in the form of hydraulic motors not illustrated in detail but supplied by those and suggested by the dotted lines.

Suitable driving of the respective wheels on each side will provide for turning of the chassis unit 1 as will be understood, and may be controlled from a control panel such as 8 from a driver station generally suggested at 9, the power unit of this machine being enclosed by a suitable enclosure such as 10 in accordance with generally conventional motor and drive means mounting practice.

It will be understood that the power or motor in the enclosure 10 drives a main hydraulic pump and motors which are arranged to be connected for driving the hydraulic instrumentalities hereinafter to be described.

Referring again, therefore to FIGS. 1 and 3, the chassis unit 1 is provided with a main frame 11 which is of generally rectilinear configuration similar to the frame of the chassis unit 1, but somewhat longer so as to extend forwardly therefrom as suggested at 12 and rearwardly therefrom as suggested at 13 in FIG. 1.

This main frame 11 is positioned over the chassis unit and adpated to move frowardly and backwardly with respect thereto as by sliding therealong, being maintained in guided relationship by the guide members 14 as shown in FIG. 3.

In order to effect the movement aforesaid, a suitable hydraulic piston and cylinder unit 15 is provided, being connected at 16 to the chassis unit 1 and at 17 to the main frame 11.

It will therefore be observed that the movement suggested by the dotted lines in FIG. 1 in respect to the housing 10 may be effected, and for purposes which will hereinafter appear.

Suitably supported in rear of the housing 10 is a secondary support member 18 which is of arcuate configuration extending from side to side of the main frame 11, and arranged for sliding movement with respect thereto and being guided and maintained in connection therewith by the guide parts 19 shown in FIG. 1.

It will thus be clear that the arcuate secondary support member 18 will move from side to side and is arcuately configured so as to move outwardly over the tires of the wheels 5 as suggested in FIG. 2, this movement being effected by suitable hydraulic piston and cylinder unit 20 connected at 21 to a rack 21*a* and at its other end to the main frame 11 at 22. The rack 21*a* in turn rotates a pinion 21*b* mounted on a shaft 21*c* having smaller pinions 21*d* near its opposite extremities. The pinions 21*d* engage racks 21*e* fixed to the support member 18, whereby the latter is moved from side to side as stated.

Suitably fixed to the secondary support member 18 is a mast assembly support 23 in the form of a transversely extending plate shown from the rear in FIG. 3, which plate 23 in turn carries on a pivot 24 the mast assembly generally denoted 25.

The mast assembly 25 consists of parallel spaced vertically extending main member 27 connected together by the transverse members 28 these vertically extending members 27 in turn supporting a frame 30 which carries the trenching wheel 31 by means of a support frame 32 generally of conventional construction which is connected at 33 to the adjustable frame 30.

This adjustable frame 30 is adapted to be moved up and down in the mast assembly 25, and on the main members 27 by a suitable hydraulic piston and cylinder unit suggested in dotted lines at 34, being connected at its lower end at 35 to the mast assembly and at 36 to the adjustable frame 30, being of course arranged for manipulation from the control panel 8 by hydraulic lines which are not shown in detail, but which may obviously be supplied.

The trenching wheel 31 is intended to be actuated for rotation by a suitable drive motor, not shown herein, but known, and perform its digging operation so as to deposit dug material on a transverse carry-off conveyor such as 37.

The mast assembly 25 is connected for fore and aft pivotal movement at 38 to the secondary support member 18 so that the mast assembly may assume the dotted line position shown in FIG. 1, this being effected by means of hydraulic piston and cylinder instrumentalities designated 39, connected at 40 to the mast assembly and at 41 to the secondary support member, and controlled from the control panel 8 as will be readily understood.

It is thus feasible for the trenching means to be raised upwardly in the mast assembly and also to be tilted forwardly so to speak in the position shown in dotted lines in FIG. 1.

It is also notable that the mast assembly 25 may be tilted from side to side as suggested by the dotted lines in FIG. 3, around the pivot 24, and limited by the limiting means 24*a* which operate in slots 24*b* of the transverse member 28.

An hydraulic piston and cylinder unit 41 connected at 42 to a transverse member 28 and at 43 to an ear extending upwardly from the member 23 to effect such angular positioning of the mast assembly 25 is provided.

In actual use of the instrumentalities hereinbefore described in detail, it will be assumed that the condition of FIG. 1 with the mast assembly 25 in vertical in dotted lines is that for starting a trench and thereafter it is desired to move to some other area and trench off to one side of the longitudinal axis of the machine, in which case the hydraulic piston and cylinder unit 20 will be actuated to move the secondary support member 18 to either side as required so as to dig close to a wall or the like for example, and the digging action effected.

Thereafter it is decided to move the machine over the highway or to another location some distance away, in which case the trenching means will be raised as by raising the frame 30 by which the same is supported by means of the hydraulic piston and cylinder unit 34, and thereafter the mast assembly 25 is tilted into the dotted line position of FIG. 1 by the hydraulic piston and cylinder unit 39.

Figure 2A:
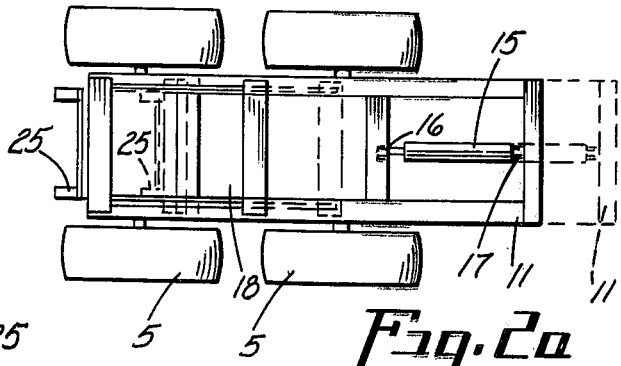

It will be understood that central positioning of the secondary support member 18 has been effected from the position of the dotted lines of FIG. 2 into the position shown in FIG. 2*a*.

Thereafter the main frame 11 is moved into the dotted line position suggested in FIG. 1 by actuation of the hydraulic piston and cylinder unit 15, so that the weight of the trenching instrumentalities or means are moved forwardly with respect to the support wheels 5, being balanced in large measure by the weight of the engine within the enclosure 10 as will be understood.

The entire unit may thereupon be moved or driven as the case may be, to a different location and subsequently by suitable manipulation of the levers at the control panel 8, effect the digging operations as desired.

I claim:

1. In a continuous digging trenching machine vehicle with a chassis unit having fixed, spaced traction means comprising forward and rearward wheels connected thereto for travel movement including forward and reverse directions, and steered by driving certain of said wheels the improvements which comprise: a main frame connected to the chassis unit for longitudinal sliding movement with respect to said chassis unit by guide means provided thereon; a mast assembly mounted on a secondary support member which is carried on the main frame, a mast connected by pivot means to the secondary support member for forward and rearward pivotal movement with respect to said secondary support member and means to mount said mast for angular displacement relative to said secondary support member; means to slidably mount said secondary support member to said main frame for transverse movement with respect to the main frame over the rearward wheels; trenching means mounted on said mast for vertical adjdustment thereon; and separate, independent operable drive means connected to drive the chassis, and to operate the trenching means for trenching, adjust the trenching means on the mast assembly, pivot the said mast angularly, pivot said mast forwardly over the main frame, move the main frame on the chassis from a rearward position with respect to the traction means to perform digging operations to a forward position with respect to the traction means for travel movement of the vehicle, and to move said secondary support member transversely; and power means for the drive means mounted on said main frame.

* * * * *